US005950684A

United States Patent [19]

Degen et al.

[11] Patent Number: 5,950,684

[45] Date of Patent: Sep. 14, 1999

[54] REMOVAL OF A WEFT THREAD IN A SERIES SHED WEAVING MACHINE

[75] Inventors: Werner Degen, Zürich; Urs Schaich, Eschenbach, both of Switzerland

[73] Assignee: Sulzer Rueti AG, Rueti

[21] Appl. No.: 08/973,043

[22] PCT Filed: Apr. 26, 1996

[86] PCT No.: PCT/CH96/00160

§ 371 Date: Nov. 25, 1997

§ 102(e) Date: Nov. 25, 1997

[87] PCT Pub. No.: WO96/38616

PCT Pub. Date: Dec. 5, 1996

[30] Foreign Application Priority Data

Jun. 2, 1995 [CH] Switzerland ..... 01639/95

[51] Int. Cl.[6] ..... D03D 51/08; D03D 47/00

[52] U.S. Cl. ..... 139/28; 139/116.2

[58] Field of Search ..... 139/28, 116.2

[56] References Cited

U.S. PATENT DOCUMENTS

| | | | |
|---|---|---|---|
| 4,502,512 | 3/1985 | Suzuki et al. | 139/116.2 |
| 4,962,793 | 10/1990 | Dussart et al. | 139/116.2 |
| 5,349,990 | 9/1994 | Gacsay | 139/28 |
| 5,469,896 | 11/1995 | Christe et al. | 139/450 |
| 5,564,473 | 10/1996 | Schaich et al. | 139/28 |

FOREIGN PATENT DOCUMENTS

| | | |
|---|---|---|
| 0 100 939 A3 | 2/1984 | European Pat. Off. . |
| 0 363 705 A1 | 4/1990 | European Pat. Off. . |
| 0 685 585 A1 | 12/1995 | European Pat. Off. . |
| 59-216956 | 12/1984 | Japan . |
| WO 86/07394 | 12/1986 | WIPO . |

*Primary Examiner*—Andy Falik

*Attorney, Agent, or Firm*—Townsend and Townsend and Crew LLP

[57] ABSTRACT

A method and an apparatus provides for the use of a sensor to detect a state which requires the removal of a weft thread inserted by a weaving rotor of a series shed weaving machine used for the formation of shed to make a cloth. Upon detection of the state, the weaving rotor is stopped before the inserted weft thread to be removed is beaten up against the cloth edge of the cloth. A weft thread removal apparatus is provided for removing the weft thread after the weaving rotor is stopped.

20 Claims, 8 Drawing Sheets

Fig.1a
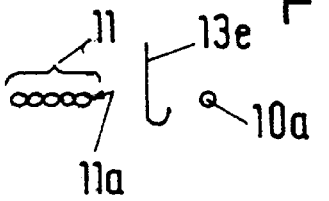
Fig.1e
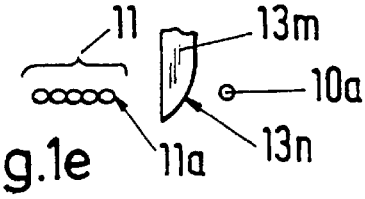
Fig.1f
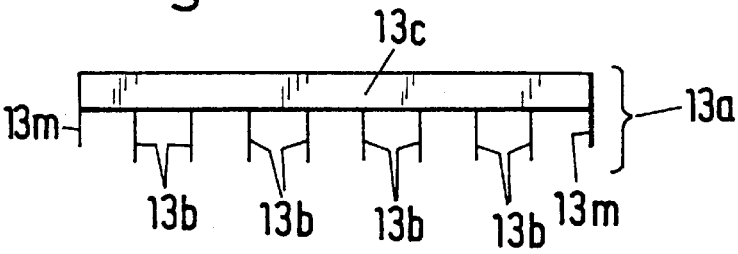
Fig.1c
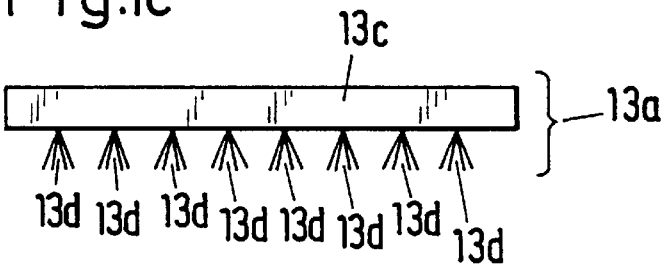
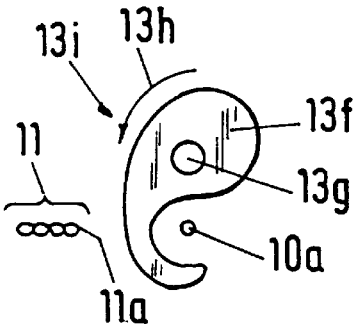
Fig.1d
Fig.1b
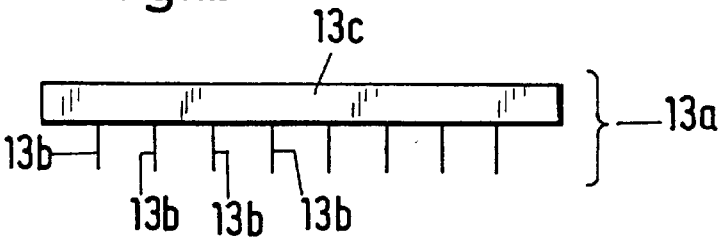

REMOVAL OF A WEFT THREAD IN A SERIES SHED WEAVING MACHINE

BACKGROUND OF THE INVENTION

The invention relates to a method as well as to an apparatus for removing a weft thread in a series shed weaving machine.

A series shed weaving machine has a roller-shaped weaving rotor which is partially encircled by warp threads. Shed forming elements are arranged on the surface of the weaving rotor which hold the warp threads in a high shed position or a low shed position respectively so that a shed moving in the direction of motion of the weaving rotor arises through which weft threads can be inserted by means of a fluid such as air. A weaving rotor has a plurality of simultaneously opened sheds so that a plurality of weft threads can be inserted into the weaving rotor simultaneously.

A disadvantage of the known series shed weaving machine is to be seen in the fact that a weft thread inserted into the weaving rotor can no longer be removed, in particular when the weft thread has already been cut at the weft insertion side. A removal of this type is required for example if the weft thread was not completely inserted into the shed due to a weft thread break or to a wad formation in the region of the weft thread tip. Furthermore, a warp thread break can arise, for example, for the elimination of which it may be necessary to remove a completely inserted weft thread.

SUMMARY OF THE INVENTION

The object of the invention is thus to provide a method as well as an apparatus for removing a weft thread in a series shed weaving machine.

The advantages of the invention are to be seen in the fact that, on the occurrence of an incorrectly inserted weft thread and/or a warp thread break, which are detected by a sensor, the weaving rotor is stopped before the inserted weft thread is beat up against the cloth edge so that the weft thread can be grasped and removed with high reliability by a weft thread removal apparatus. The invention has the further advantage that the cloth edge is treated very carefully during the removal of the weft thread so that no start-up places result on resuming the weaving process.

BRIEF DESCRIPTION OF THE DRAWINGS

FIG. 1*a* is an elevational view schematically illustrating a removing means executed in hook shape;

FIGS. 1*b*, 1*c*, 1*f* are elevational views schematically illustrating a removing means executed in comb shape;

FIG. 1*d* is an elevational view schematically illustrating a removing means executed in winder shape, i.e. in the shape of a hook winder;

FIG. 1*e* is an elevational view schematically illustrating a cutter device fastened to the removal means;

DESCRIPTION OF THE PREFERRED EMBODIMENTS

Figure 3:
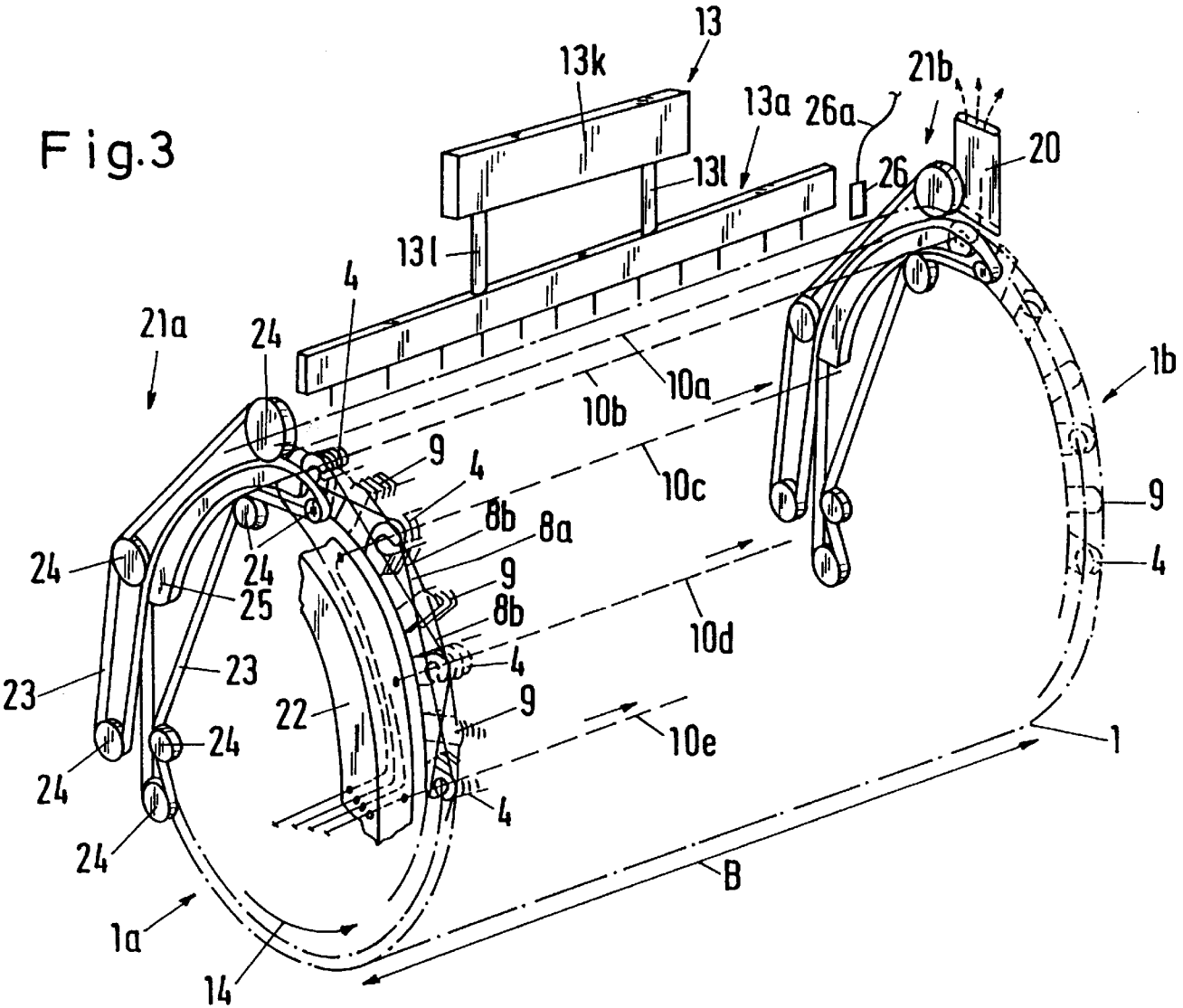
FIG. 3 is a perspective view of a series shed weaving machine.

FIG. 3 is a perspective view of components of a series shed weaving machine, in particular a weaving rotor 1 with a weft thread distributor apparatus 22, a weft thread removal device 13 as well as a holder device 21*a* on the weft thread insertion side 1*a* and a holder device 21*b* on the weft thread arrival side 1*b*. The roll-like weaving rotor 1 has shed holder members 4 on its surface which are arranged adjacent to one another, extend in a straight line over the entire breadth B of the weaving rotor 1 and thereby place the warp threads 8*a*, 8*b*, which partially encircle the weaving rotor 1, into a high shed or a low shed position respectively. In this way a shed 16 arises between the warp threads 8*a*, 8*b* through which a weft thread 10*a*, 10*b*, 10*c*, 10*d*, 10*e* can be inserted. At the surface of the roller shaped weaving rotor 1 shed holder, members 4 are arranged to be distributed over the entire periphery in such a manner that a plurality of sheds 16 moving in parallel through each of which a weft thread 10*a*, 10*b*, 10*c*, 10*d*, 10*e* can be inserted are simultaneously open. In the peripheral direction of the weaving rotor, beat-up elements 9 are arranged between the shed holder members 4 which serve to beat the weft thread 10*a* up against the cloth edge 11*a*. In the exemplary embodiment shown four weft threads 10*b*, 10*c*, 10*d*, 10*e* are simultaneously being inserted, with a weft thread distributor apparatus 22 supplying the weft threads to an opened shed 16. The weft thread 10*a* is already completely inserted into the weaving rotor 1, extending over the entire width of the weaving rotor 1, and is held at the weft thread insertion side 1*a* by a holder apparatus 21*a* and at the weft thread arrival side 1*b* by a further holder apparatus 21*b* and forwarded to the cloth edge 11*b* with a movement proceeding in the direction of rotation 14.

The holder apparatus 21*a*, 21*b* has an elastic band 23 between which the weft thread 10*a* is held. Deflection rollers 24 as well as a support element 25 determine the path of the elastic band 23. A stretcher nozzle 20 is placed at the weft thread arrival side 1*b* in order to hold a weft thread 10*b* which has just been completely inserted under tension until it is captured by the holder apparatus 21*b* and forwarded further.

Sensors 26 can be placed at the surface of the weaving rotor 1 both on the weft thread insertion side 1*a* and on the weft thread arrival side 1*b* for monitoring the weft threads 10*a*, 10*b*, 10*c*, 10*d*, 10*e*. In the embodiment shown a sensor 26 is placed at the weft thread arrival side 1*b* in order to monitor a complete insertion of the weft thread 10*a*. The sensor 26 is connected to a subsequent electronic evaluation circuit via an electrically conducting connection means 26*a*. Furthermore, the warp threads 8*a*, 8*b* can also be monitored by sensors in order to detect a warp thread break. Above the weaving rotor 1 there is placed a weft thread removal apparatus 13 which comprises a removal means 13*a* which is connected to a drive device 13*k* via a connection means 131. Electromotoric drives are provided in the drive device 13*k* in order to displace the removal means 13*a* in a translational and/or rotational movement. The drive device 13*k* can also be movable through other types of drives such as, for example, through pneumatic drives.

Figure 2A:
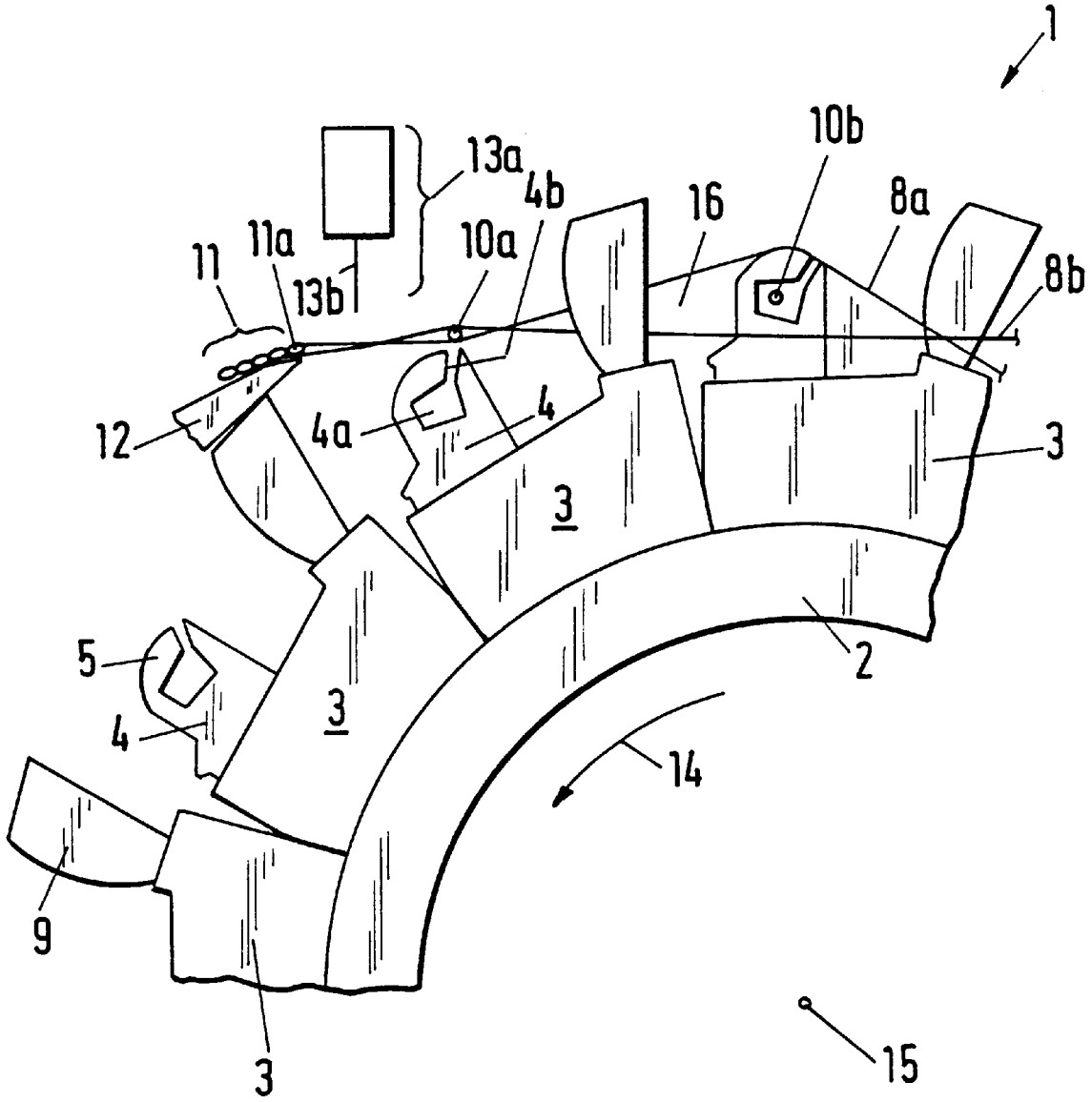
FIGS. 2*a*–2*d* are elevational views schematically illustrating various positions of the weaving rotor as well as of the weft thread removal device during the removal of weft threads.

FIG. 2*a* shows a side view of a weaving rotor 1 rotating in the direction of rotation 14 with a center of rotation 15. Anchoring elements 3 are placed on its cylinder-shaped base body 2 each of which holds a shed holder member 4 as well as a beat-up element 9. The shed holder element 4 has a guide section 5 into which warp threads 8*a* are laid in such a manner that they are held in the high shed position. Further warp threads 8*b* extend alongside the shed holder member 4 so that these warp threads 8*b* take on a low shed position. Thus a shed 16 arises between the warp threads 8*a*, 8*b* through which a weft thread 10*b*, moving within the shed holder member 4, can be inserted with the help of a fluid such as air. The warp threads 8*a*, 8*b* move over a cloth table 12, with the cloth 11 being produced lying on the cloth table 12 and with a cloth edge 11*a* being formed. The weft thread 10*a* is held by the warp threads 8*a*, 8*b* and is brought from the channel 4*a* with movement through the opening 4*b* into the position shown. A removal means 13*a* with a needle 13*b* is placed above the weaving rotor 1. The drive 13*k* moving the removal means 13*a* is not shown.

Figure 2B:
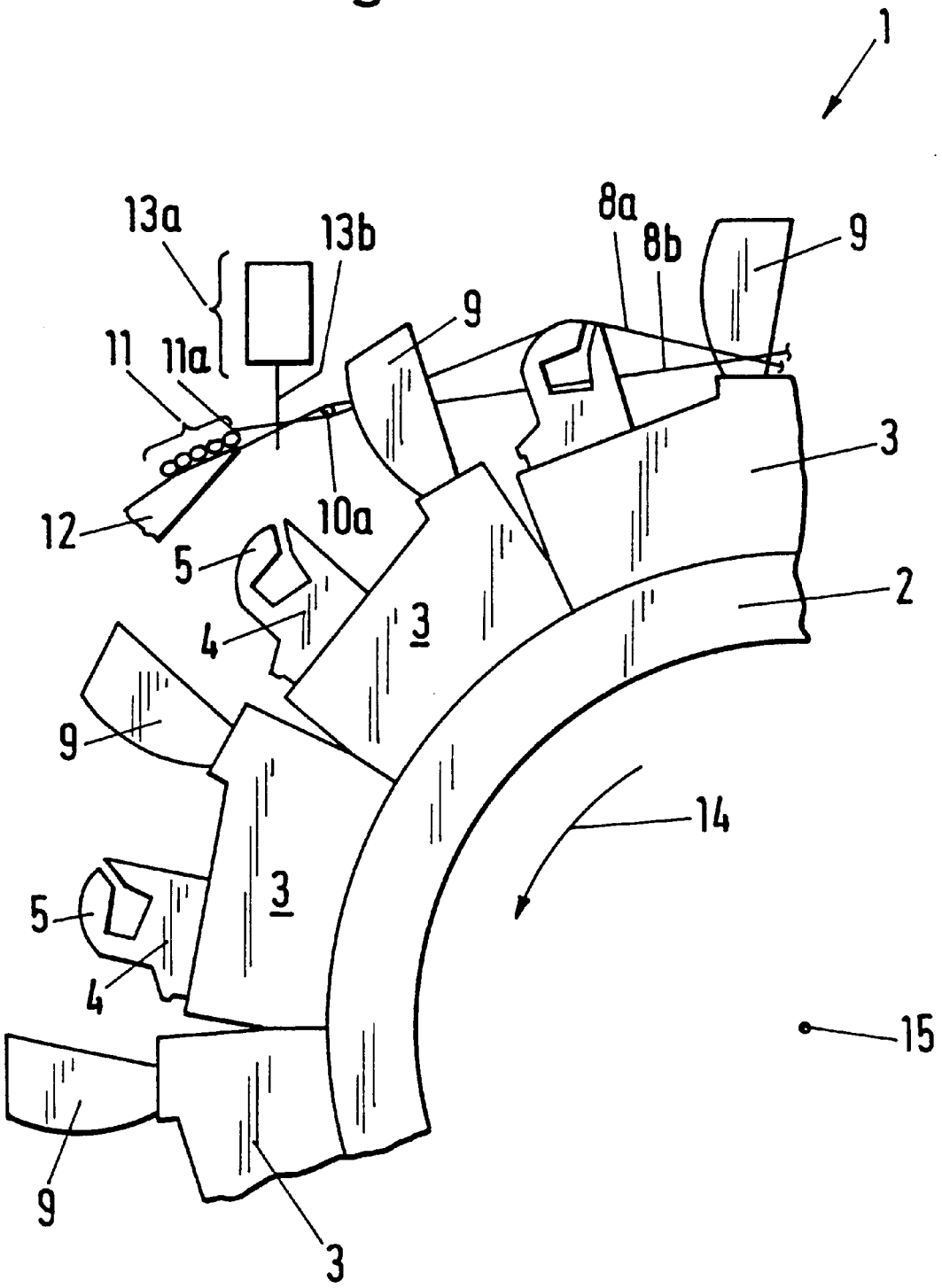
Figure 4:
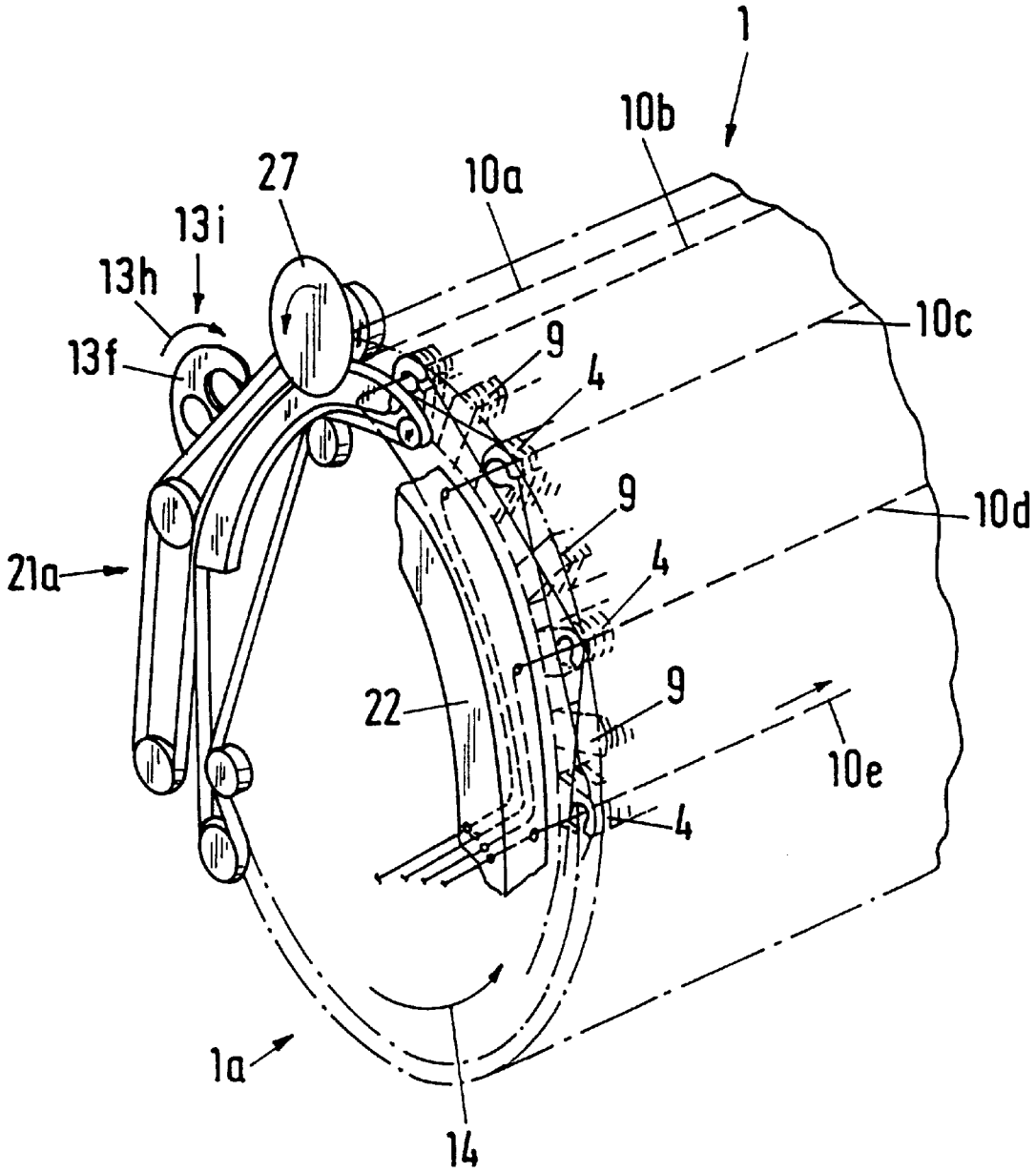
FIG. 4 is a further perspective view of the part of a further series shed weaving machine at the weft insertion side.

As soon as a sensor 26 detects a state which requires the removal of an inserted weft thread 10*a*, the weaving rotor is stopped after said state is detected and before the weft thread 10*a* to be removed is beaten up against the cloth edge. FIG. 2*b* shows a weaving rotor 1 which has been braked and is now standing still. In this position the weft thread 10*a* held between the warp threads 8*a*, 8*b* can be removed by the removal means 13*a*. The removal means 13*a* can have, for example, a needle 13*e* executed in hook shape which, as shown in FIG. 1*a*, dips between the cloth edge 11*a* and the weft thread 10*a* and is moved by the drive 13*k* in such a manner that the hook 13*e* captures the weft thread 10*a* and either pulls out and removes the latter completely from out of the warp threads 8*a*, 8*b* or at least partly pulls the weft thread 10*a* out of the warp threads 8*a*, 8*b* so that it can be completely removed by a further apparatus or else by hand. The removal means can also, as shown in FIG. 1*d*, be executed as a rotating hook-shaped or winder-shaped removal means 13*i* which comprises a hook-shaped removal part 13*f* which is journalled rotatably in the direction of rotation 13*h* about a center of rotation 13*g*. A rotating removal means 13*i* of this type can be placed outside the cloth width B either at the weft thread insertion side 1*a* or at the weft thread arrival side 1*b*. FIG. 4 shows a removal means 13*i* placed at the weft thread insertion side 10*a*. The weft thread 1*a* was cut by a rotating cutter device 27 so that the end of the weft thread 10*a* is held by the holder apparatus 21*a*. A rotation of the removal means 13*i* causes, as shown in FIG. 1*d*, the hook-shaped removal part 13*f* to dip between the cloth edge 11*a* and the weft thread 10*a* so that the weft thread 10*a* is grasped and pulled out from the warp threads 8*a*, 8*b* while being wrapped up about the removal means 13*i*. In addition the weft thread 10*a* is pulled out of the holder device 21*a* so that the weft thread 10*a* is completely removed by the removal means 13*i*.

When the weaving rotor 1 is standing still it is generally necessary to remove the not yet completely inserted weft threads 10*b*, 10*c*, 10*d* and 10*e* as well in addition to removal of the weft thread 10*a* in order to ensure a trouble-free start-up of the weaving rotor 1. Since the weft threads 10*b*, 10*c*, 10*d*, 10*e* have not yet been cut at the weft thread insertion side 1*a*, they can be pulled back by non-illustrated weft thread forwarding apparatuses placed ahead of the weft thread distributor apparatus 22 so that the weft threads 10*b*, 10*c*, 10*d*, 10*e* can thus be completely removed from the weaving rotor 1. The weft threads 10*b*, 10*c*, 10d, 10*e* located in the weaving rotor 1 can also be separated from the thread supplied in by a separate cutter device and removed by a further weft thread removal device or else by hand. In FIG. 2*b* the weft thread 10*b* still present in FIG. 2*a* was pulled back by the weft thread forwarding apparatus and removed in this manner. The removal of the weft thread 10*a* in the situation illustrated in FIG. 2*b* can prove difficult, for example if the weft thread 10*a* and the warp threads 8*a*, 8*b* are constituted in such a manner that they exert high mutual frictional forces so that pulling the weft thread 10*a* out from between the warp threads 8*a*, 8*b* is hardly possible or possible only with the use of a large force.

Figure 2C:
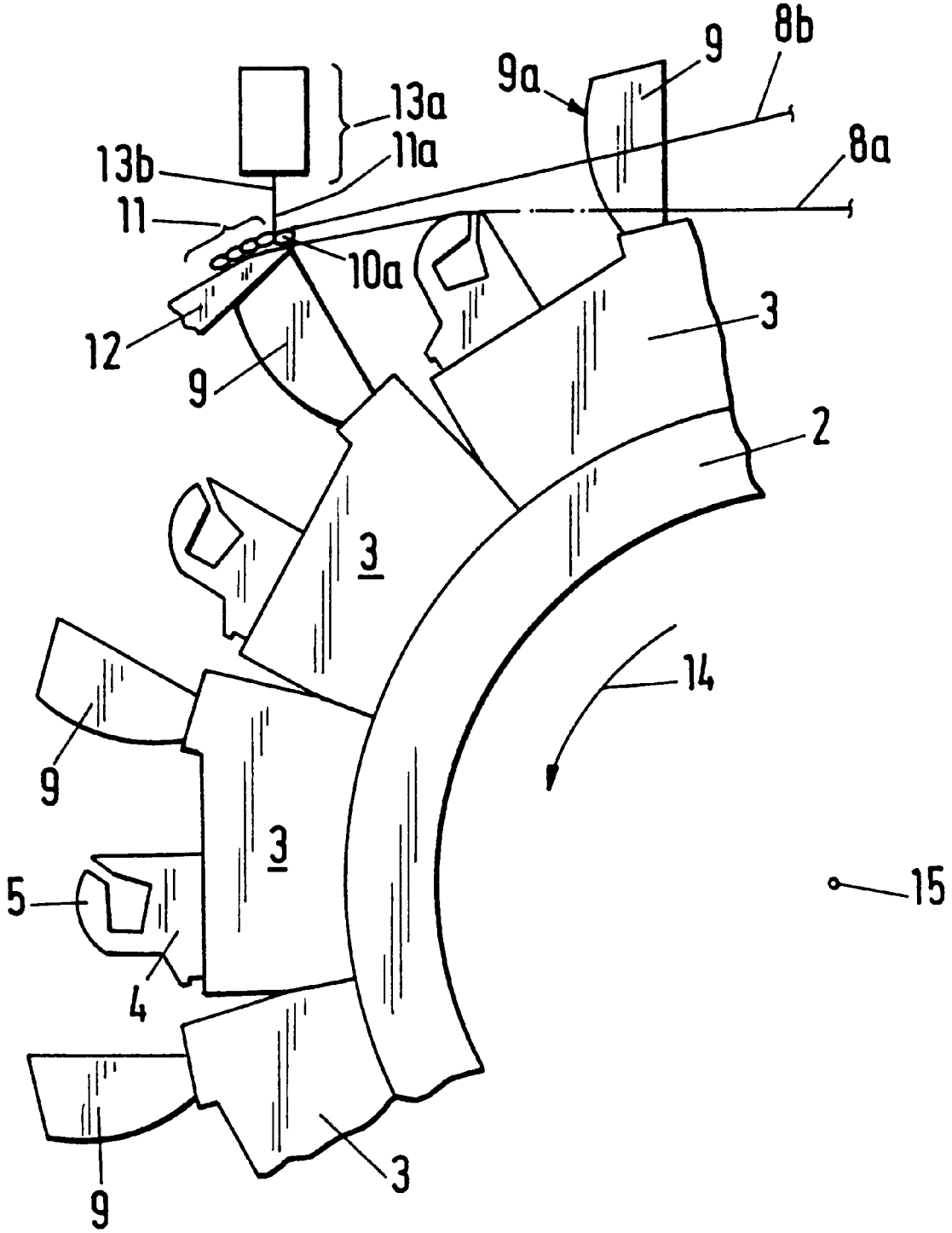
Figure 2D:
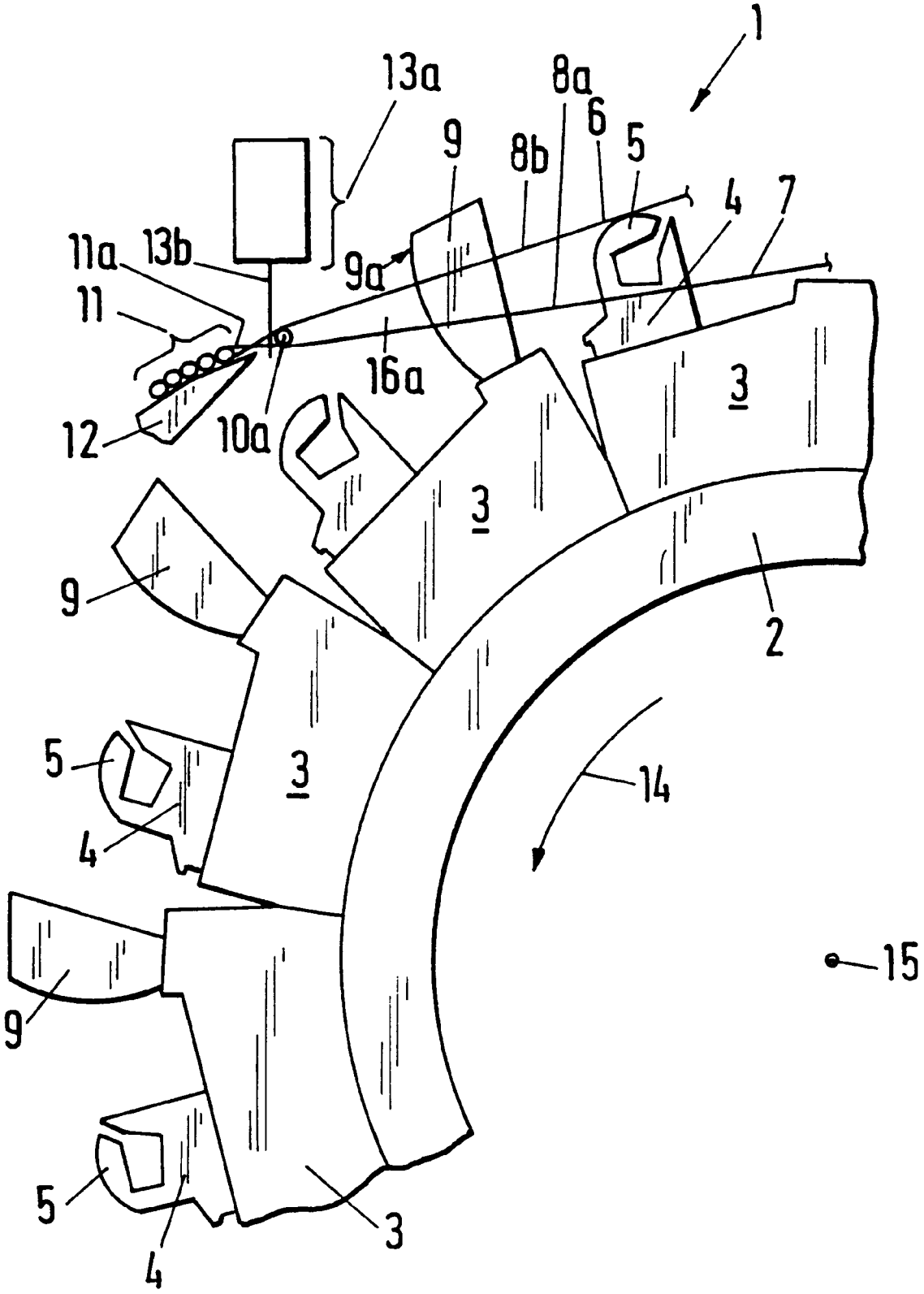

It can thus prove advantageous to further rotate the weaving rotor 1, which is standing still as in FIG. 2*b*, in the direction of rotation 14 as shown in FIG. 2*c*, with the weft thread 10*a* being beaten up against the cloth edge 11*a* by the abutment element 9. The weaving rotor 1 is turned still further, as shown in FIG. 2*d*, until the shed 16*a* is ideally opened, and then the weaving rotor 1 is brought to a standstill. In order to remove the weft thread 10*a* beat up against the cloth edge 11*a* from the latter, the following method is used: An elongate cross-beam 13*c* is used as a removal means 13*a* which has needles 13*b* or tufts 13*d* or bristles at regular spacings which extend towards the warp threads 8*a*, 8*b*. When a state arises which requires the removal of the weft thread 10*a*, the weaving rotor 1 is stopped, as shown in FIG. 2*b*, and the needles 13*b* of the removal means 13*a* are dipped into the warp threads 8*a*, 8*b* over the entire web width B. Then the weaving rotor 1 is rotated further, as shown in FIG. 2*c*, with the removal means 13*a* being moved along with it in such a manner that the weft thread 10*a* is beaten up against the cloth edge 10*a*, with the needles 13*b* coming to lie between the weft thread 10*a* and the cloth edge 11*a*. After the further opening of the shed 16*a*, the weft thread 10*a* is pushed as shown in FIG. 2*d* by the needles 13*b* of the removal means 13*a* away from the cloth edge 11*a* in the direction of the shed 16*a* so that the weft thread 10*a* comes to lie relatively loosely between the warp threads 8*a*, 8*b*. The weft thread 10*a* can then be removed by means of a rotating removal means 13*i* or, for example, with a hook 13*e* in the manner already described previously. The spacing between the individual needles 13*b* or the tufts 13*d* respectively is chosen differently in dependence on the material of the warp threads 8*a*, 8*b* or for example, on the warp thread density. A spacing of less than or equal to 15 mm has proved to be an advantageous distance between the individual needles 13*b* or tufts 13*d*.

Figure 5:
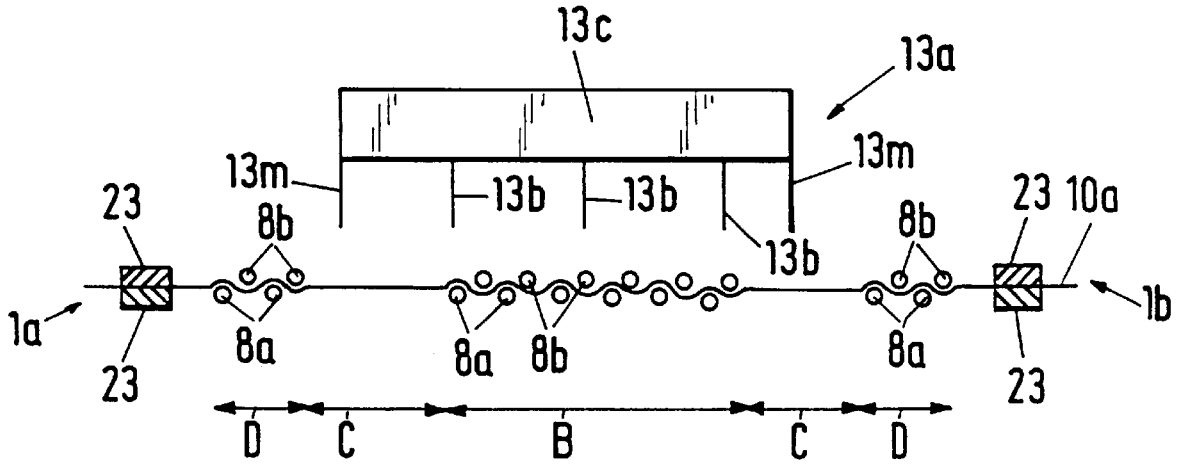
FIG. 5 is a section through a cloth with auxiliary edges.

FIG. 5 shows a longitudinal section through a cloth. The weft thread 10*a* is held at the weft thread insertion side 1*a* by an elastic band 23, passes through between the warp threads 8*a*, 8*b* and is held at the weft thread arrival side 1*b* by a further elastic band 23. In the example shown the finished cloth has a width B, followed by a zone C joined to the finished cloth without warp threads 8*a*, 8*b*, and then with an auxiliary edge D formed by the weft thread 10*a* and the warp threads 8*a*, 8*b* being arranged afterwards. A removal means 13*a* is placed above the cloth and comprises a cross beam 13*c* as well as needles 13*b*. The removal means 13*a* also has a cutter device 13*m* at both sides which severs the weft thread 10*a* in the zone C when the needles 13*b* dip into the warp threads 8*a*, 8*b* so that the weft thread 10*a* is more easily removed from the finished cloth with width B.

FIG. 1*f* again shows an exemplary embodiment of a removal means 13*a* with a cross beam 13*c* and regularly spaced needles 13*b*, with a cutter device 13*m* being placed at each end of the cross beam 13*c*, which is executed in the present exemplary embodiment as a blade with a cutting edge 13*n*. FIG. 1*e* shows a side view of the blade 13*m* with a cutting edge 13*n* which is submerged between the cloth edge 11*a* and the weft thread 10*a* so that the weft thread 10*a* is severed, either by the weft thread 10*a* being beaten up and thus pressed against the cutting edge 13*n*, or by the cutting edge 13*n* being moved towards the weft thread 10*a*.

The braking of the weaving rotor 1 must be done very rapidly, as shown in FIG. 2*b*, within a fraction of a rotation of the weaving rotor 1. This is made possible by a brake device acting on the weaving rotor which was exclusively on the weaving rotor so that the weaving rotor 1 is braked asynchronously to the movement of the other components.

This enables a very rapid braking of the weaving rotor. The brake device is not shown. It acts advantageously on the central shaft of the weaving rotor. The asynchronous braking of the weaving rotor 1 has the advantage that the weaving rotor can be braked with the entire braking force available from the brake device without regard to the other components of the series shed weaving machine. The weaving rotor 1 can thereby be braked as quickly as possible. The weaving rotor is advantageously driven by a separate electric motor so that the weaving rotor 1 is kinematically completely separated from the other components of the series shed weaving machine. The brake device can be provided as a separately arranged device which exerts a braking action on the weaving rotor when required. It is furthermore possible to use the electric motor as a brake device in order to bring the weaving rotor to a standstill.

When the weaving operation is resumed the weaving rotor 1 and the further components of the series shed weaving machine are brought into a defined mutual position before the weaving rotor and the components, now moving in synchronism, are started up in order to resume the weaving operation. The series shed weaving machine can assume the mutually defined position automatically since the individual components are monitored by a rotation angle sensor so that their current angle of rotation is known, and the individual components can be brought into a prespecifiable angular position by means of electromotoric drives.

We claim:

1. A method for the removal of a weft thread from a series shed weaving machine having a weaving rotor which is rotated in a direction of rotation for the formation of a weaving shed to make a cloth, the method comprising the steps of:

detecting a state which requires a removal of a weft thread which has been inserted by the weaving rotor;

stopping the weaving rotor upon detecting the state and before the inserted weft thread which is to be removed is beaten up against a cloth edge of the cloth;

introducing a removal member of a weft thread removal apparatus between the cloth edge and the inserted weft thread which is to be removed;

rotating the weaving rotor further in the direction of rotation to forward the inserted weft thread up to the cloth edge and to open a shed at the weft thread;

stopping the weaving rotor upon opening of the shed; and removing the inserted weft thread from the shed using the removal member.

2. A method in accordance with claim 1 further comprising, prior to removing the inserted thread, removing other weft threads which are located in the weaving rotor.

3. A method in accordance with claim 2 wherein the other weft threads are removed using a weft thread forwarding apparatus.

4. A method for the removal of a weft thread from a series shed weaving machine having a weaving rotor for the formation of a weaving shed to make a cloth and having other components, the method comprising the steps of:

detecting a state in which removal of an inserted weft thread is required;

stopping the weaving rotor upon detecting the state and before the inserted weft thread which is to be removed is beaten up against a cloth edge of the cloth; and removing the inserted weft thread using a weft thread removal apparatus.

5. A method in accordance with claim 4 wherein the weaving rotor is stopped asynchronously to movement of the other components of the series shed weaving machine.

6. A method in accordance with claim 4 wherein the state in which removal of the inserted weft thread is required involves an irregularity in the insertion of the weft thread or a break in a warp thread.

7. A method in accordance with claim 4 wherein the step of removing the insert weft thread comprises introducing a removal means of the weft thread removal apparatus between the cloth edge and the inserted weft thread to reach the inserted weft thread.

8. A method in accordance with claim 4 wherein the step of removing the insert weft thread comprises grasping the inserted weft thread in a region inside a cloth width of the cloth.

9. A method in accordance with claim 4 wherein the step of removing the insert weft thread comprises grasping the inserted weft thread in a region outside a cloth width of the cloth.

10. A method in accordance with claim 4 further comprising, upon removing the inserted weft thread, repositioning and restarting the weaving rotor to resume the weaving process.

11. An apparatus for removal of a weft thread from a series shed weaving machine having a weaving rotor which is rotated in a direction of rotation for the formation of a weaving shed to make a cloth, the apparatus comprising:

at least one sensor for detecting a state which requires a removal of a weft thread which has been inserted by the weaving rotor;

a braking device for stopping the weaving rotor when the sensor detects the state which requires the removal of the inserted weft thread; and a weft thread removal device for removing the inserted weft thread when the weaving rotor is stopped.

12. An apparatus in accordance with claim 11 wherein the at least one sensor comprises a sensor adapted to be disposed at a weft thread insertion side of the weaving rotor.

13. An apparatus in accordance with claim 11 wherein the at least one sensor comprises a sensor adapted to be disposed at a weft thread arrival side of the weaving rotor.

14. An apparatus in accordance with claim 11 wherein the at least one sensor is configured for detecting irregularity in the insertion of the weft thread or a break in a warp thread.

15. An apparatus in accordance with claim 11 wherein the weft thread removal device includes a removal member for removing the inserted weft thread.

16. An apparatus in accordance with claim 15 wherein the removal member comprises a comb-like member extending parallel to a cloth edge of the cloth and having a plurality of needles, bristles or tufts.

17. An apparatus in accordance with claim 16 wherein the distance between individual needles, bristles or tufts is less than or equal to 15 mm.

18. An apparatus in accordance with claim 15 wherein the removal member comprises a hook-shaped member.

19. An apparatus in accordance with claim 11 wherein the weft thread removal device includes at least one cutter device for severing the inserted weft thread.

20. An apparatus in accordance with claim 19 wherein the at least one cutter device is configured for severing the inserted weft thread outside a cloth width of the cloth.

* * * * *